United States Patent [19]

Hosbein et al.

[11] Patent Number: 4,529,178

[45] Date of Patent: Jul. 16, 1985

[54] EXPANSIBLE REFRACTORY BRICK ASSEMBLY FOR A FURNACE ROOF

[75] Inventors: John W. Hosbein, Northbrook; Roger L. Hosbein, Glencoe, both of Ill.

[73] Assignee: M. H. Detrick Company, Itasca, Ill.

[21] Appl. No.: 577,571

[22] Filed: Feb. 6, 1984

[51] Int. Cl.[3] ..... F27B 3/10

[52] U.S. Cl. ..... 266/283; 266/285; 110/331; 110/340

[58] Field of Search ..... 266/280, 283, 287, 285, 266/286; 110/181, 173.4, 331, 338–340, 335

[56] References Cited

U.S. PATENT DOCUMENTS

| | | | |
|---|---|---|---|
| 1,500,240 | 7/1924 | Griffith | 266/285 |
| 2,585,552 | 2/1952 | Hosbein | 432/252 |
| 3,015,288 | 1/1962 | Hosbein et al. | 110/335 |
| 3,077,362 | 2/1963 | Hosbein | 294/87 R |
| 3,109,702 | 11/1963 | Hosbein et al. | 264/277 |
| 3,132,447 | 5/1964 | Hosbein | 52/487 |
| 3,197,930 | 8/1965 | Kimmlinger et al. | 52/378 |
| 3,225,721 | 12/1965 | Rowley | 110/258 |
| 3,230,914 | 1/1966 | Mann | 110/335 |
| 3,239,972 | 3/1966 | Hosbein et al. | 52/99 |
| 3,239,984 | 3/1966 | Hosbein | 52/487 |
| 3,350,085 | 10/1967 | Over | 266/283 |
| 3,353,800 | 11/1967 | Jens | 261/3 |
| 3,362,698 | 1/1968 | Cerny et al. | 432/119 |
| 3,375,795 | 4/1968 | Merkle, Jr. | 110/331 |
| 3,726,064 | 4/1973 | Rowley | 55/241 |
| 4,151,693 | 5/1979 | Harvey | 52/405 |
| 4,286,529 | 9/1981 | Musser | 110/340 |
| 4,291,514 | 9/1981 | Harvey | 52/509 |
| 4,389,189 | 6/1983 | Harvey et al. | 432/247 |

FOREIGN PATENT DOCUMENTS

| | | | |
|---|---|---|---|
| 1571434 | 11/1966 | Fed. Rep. of Germany | 110/339 |
| 268527 | 8/1961 | Netherlands | 266/283 |
| 197891 | 5/1964 | Sweden | 266/283 |

*Primary Examiner*—L. Dewayne Rutledge
*Assistant Examiner*—Christopher W. Brody
*Attorney, Agent, or Firm*—Wood, Dalton, Phillips, Mason & Rowe

[57] ABSTRACT

A refractory assembly for use in a roof in an ore reduction furnace is provided having a pair of refractory blocks with matchable corrugated surfaces. A corrugated plate is provided, with its corrugations having the same wavelength as and a different amplitude than the block corrugations. The plate is bound between the corrugated surfaces of the blocks so that the blocks are spaced apart by and supported on the plate. In the preferred embodiment, the corrugations are sine waves with the plate sine wave having an amplitude greater than the sine wave of the blocks. The entire assembly may be suspending as part of a furnace roof.

30 Claims, 14 Drawing Figures

FIG. 1
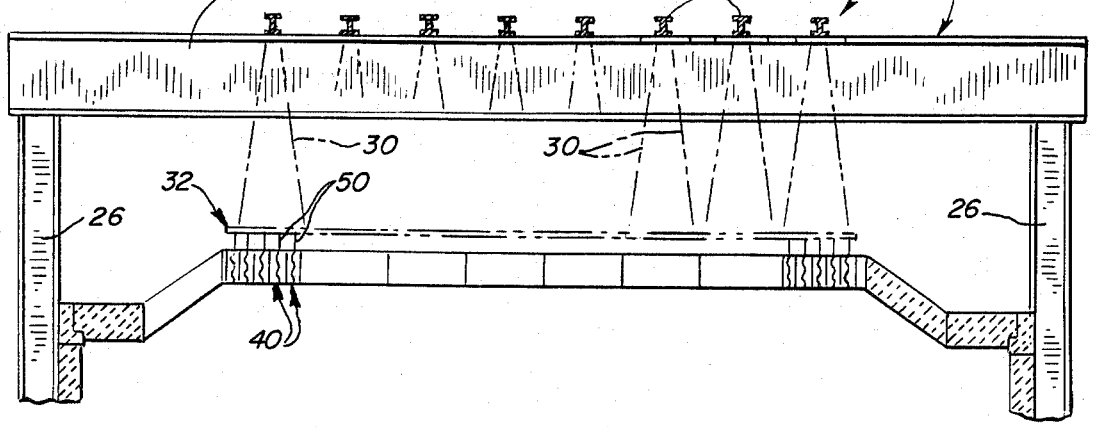
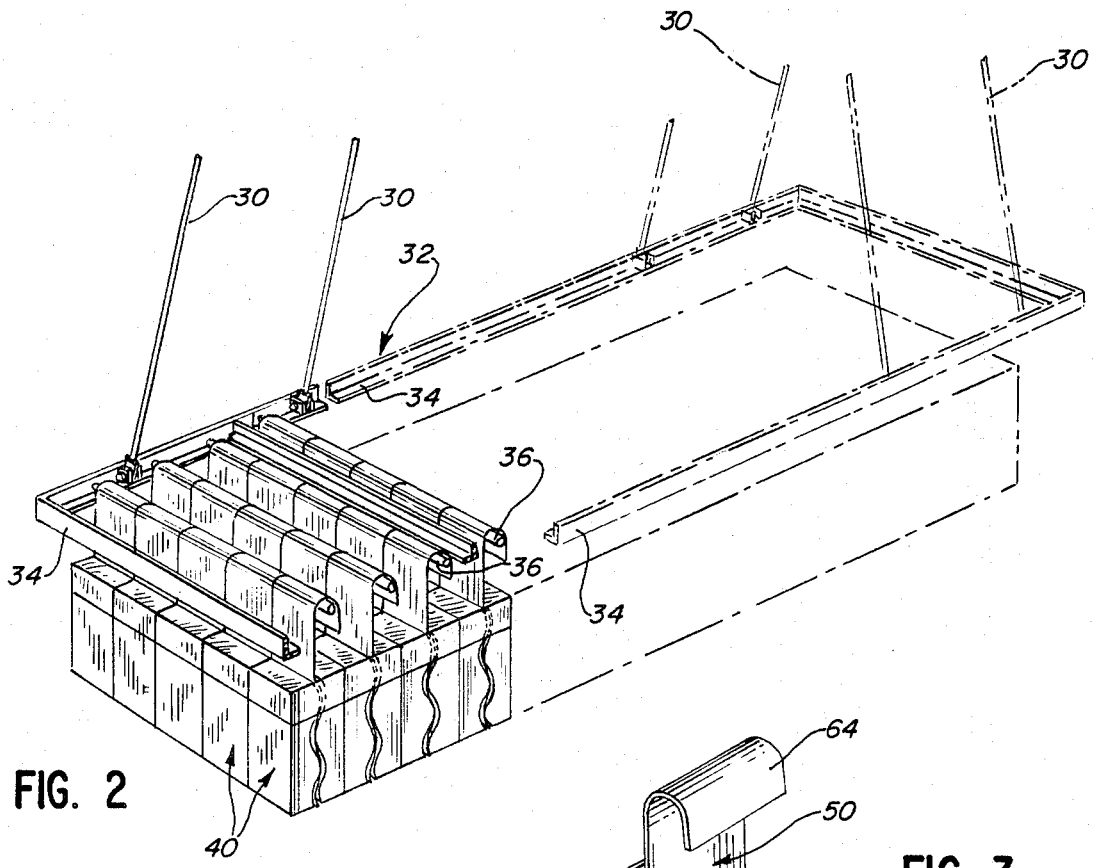
FIG. 2
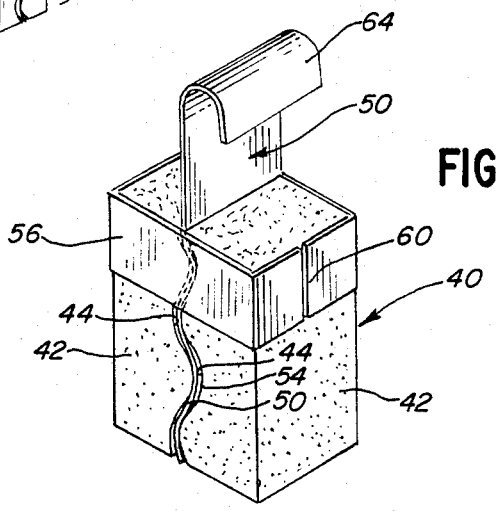
FIG. 3

EXPANSIBLE REFRACTORY BRICK ASSEMBLY FOR A FURNACE ROOF

BACKGROUND OF THE INVENTION

1. Field of the Invention

This invention relates to refractory furnace roofs and more particularly to a refractory structure which allows for expansion in an ore reduction furnace roof.

2. Background Art

Large ore reduction furnaces are common in the range of 20 to 40 feet and larger. In furnaces of this size, it is necessary to suspend a refractory roof above the furnace which will enclose the furnace and retain the heat therein. Such roofs typically consist of a number of ceramic blocks or bricks suspended in some way above the furnace.

Inasmuch as the roof is subject to extreme environmental conditions, with temperatures in the range of 2500° F. to 3000° F., and with reactive materials such as sulphur in the atmosphere beneath the roof, the roof will gradually burn away over time. For example, a fifteen inch deep brick might burn down to four inches in only six months or a year depending upon the environment. The environment will vary between furnaces, with the corrosive nature of the environment depending largely upon the sulphur content of the ore being used. Also, since the heat is generally not uniform across the roof, some parts of the roof will burn away at a faster rate than other parts.

Furnace roofs must commonly allow for expansion across the roof (i.e. in the horizontal plane) of 10 percent, or even more. If this were not done, the roof would build up dangerous pressures against the enclosure around its perimeter and would either buckle or break the enclosure. The expansion which must be allowed for includes both thermal expansion, most of which occurs at the beginning of the service life of the bricks, and permanent chemical expansion, due to chemical reactions of the furnace atmosphere with the oxides and bond materials of the roof. The chemical expansion is permanent in that the bricks will maintain that expansion even when they are removed from the furnace environment.

One type of roof which is commonly used to deal with these problems is the panelized roof disclosed in U.S. Pat. No. 3,375,795. Such roofs include multiple brick pairs suspended from a frame, each frame therefore supporting the bricks in a roof panel. Multiple panels are suspended together to form the roof. With small numbers of bricks supported together in this manner, it has been possible to remove and replace those particular parts of the roof which have burned down without replacing those bricks which burned away at a slower rate before it was necessary.

The bricks which have been used in such roofs have been supported by castings which are hooked over the panel frame and which have outwardly directed projections which fit into sockets in the bricks, as shown for example in U.S. Pat. Nos. 3,230,914 and 3,375,795. Forming the bricks with these sockets is however difficult and expensive. Further, the bricks are susceptible to breaking around the socket. Still further, the sockets in the bricks create pockets which have reduced refractory capabilities.

To allow for expansion in such panelized roofs, the panels have been spaced apart when installed by placing various expansion materials between entire panels or rows of bricks. Expansion materials such as wood, corrugated metal plates, or refractory fiber have been used, all of which either burn away or compress to allow for the brick expansion. However, inasmuch as expansion might be 10% or more in severe environments, and since each piece of expansion material has had to accommodate the expansion of numerous bricks, large gaps are required initially for expansion materials large enough to allow for such expansion. Since the expansion materials do not have the refractory characteristics of the bricks, these roofs have thus had large areas with low refractory capability.

The present invention is directed toward overcoming one or more of the problems as set forth above.

SUMMARY OF THE INVENTION

In one aspect of the present invention, a refractory assembly for use in an ore reduction furnace roof is provided having a pair of refractory blocks with matchable corrugated surfaces. A hanging or supporting plate is provided between the blocks, which plate contacts each block at least once on each corrugated surface on alternating sides along the plate height, the contacts extending across the width of the contacted block surface to act as a heat barrier.

In another aspect of the invention, the block supporting plate is also corrugated, with its corrugations having the same wavelength as the block corrugations and a different amplitude than the block corrugations. The two blocks are banded against the supporting plate with the plate corrugations between and substantially in phase with the block corrugations. The block and supporting plate corrugations therefore provide an interference therebetween sufficient to carry the brick weight on the supporting plate.

In still another aspect of the present invention, a panel for use in furnace roofs is disclosed having a frame with spaced support bars from which a plurality of refractory assemblies as described above are suspended.

With the present invention, each brick may be formed the same, having an identical wavy or corrugated surface. Accordingly, production of the bricks is simple and the cost is minimized. Also, the brick corrugated surfaces are spaced apart when initially installed in the roof to thereby allow for subsequent expansion. However, while the plate spaces the bricks apart, it also contacts the bricks across the width of the assembly, and therefore acts as a heat barrier against gas and heat passage upwardly between the bricks. The heat barrier provided by the plate remains even as the bricks burn away, as there are multiple such areas of contact along the height of the assembly. Also, since each spacing accommodates expansion of only one or a few brick pairs, the large gaps in the roof refractory materials required for expansion materials in the prior art are not necessary.

Significantly, the present invention not only spaces apart the bricks to allow for expansion, but it also supports the bricks on the plate without requiring sockets in the bricks. Accordingly, the bricks may be more inexpensively and easily made. Further, by eliminating the sharp edges, etc. which are in most sockets, the bricks are much less susceptible to breaking. Still further, the bricks do not have the significantly reduced refractory characteristics of most bricks with sockets.

BRIEF DESCRIPTION OF THE DRAWINGS

FIG. 1 shows a furnace roof which embodies the present invention;

FIG. 2 is a partial perspective view of a panel embodying the present invention;

FIG. 3 is a perspective view of one embodiment of the present invention;

DESCRIPTION OF THE PREFERRED EMBODIMENTS

Figure 4:
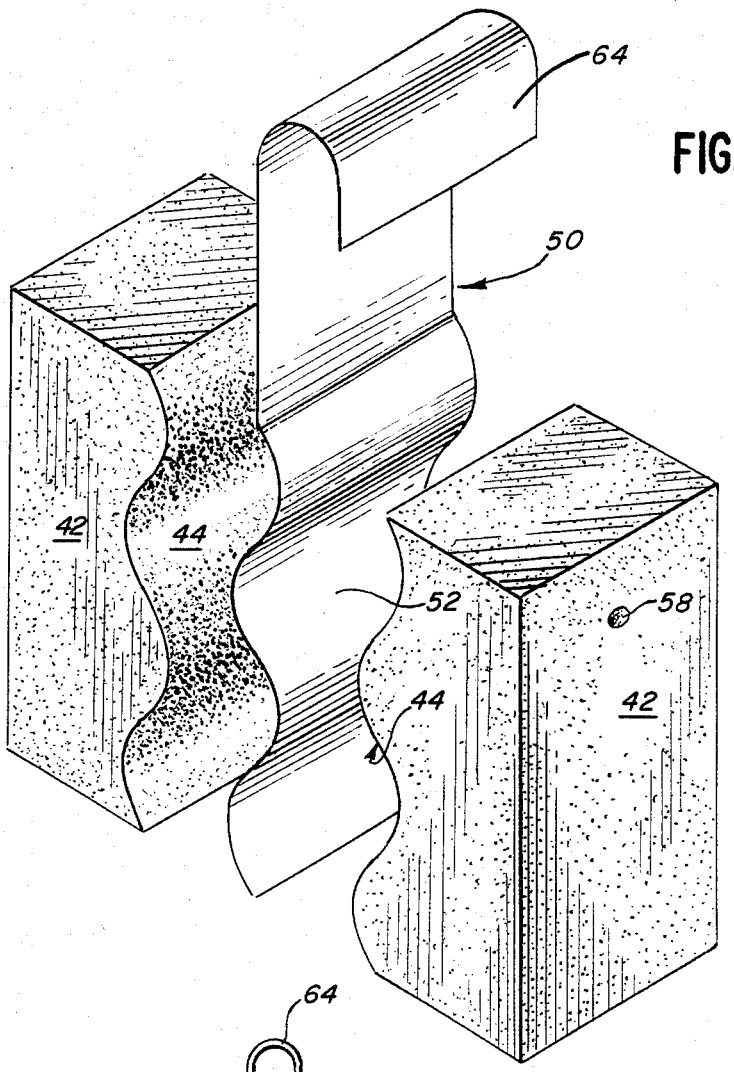
FIG. 4 is a partial exploded view of the embodiment shown in FIG. 3.

A furnace roof 20 with which the present invention may be used is shown in FIG. 1. The roof 20 includes a superstructure 22 having spaced parallel pairs of primary girders 24 supported on their ends by suitable columns 26 on opposite sides of the roof 20. Only one set of columns 26 and primary girders 24 are shown, though it should be understand that there are a number of such girders 24 and columns 26 in most installations. A plurality of laterally spaced secondary girders 28, such as the I-beams shown, extend between primary girders 24 and longitudinally of the furnace roof 20.

The secondary girders 28 have downwardly extending support rods 30 (shown in phantom in FIG. 1, see also FIG. 2) which are suitably secured to and support a rectangular frame 32 which is supported in a horizontal plane. The frame 32 may be made of suitable material such as angle irons 34 suitably secured together, as by welding the corners together.

Spaced elongated members 36 such as bars or pipes, extend transversely of the frame 32 between the angle irons 34. These pipe members 36 do not have definitely fixed spacing to allow for minor dimensional irregularities in the refractory assemblies 40 suspended therefrom. The entire structure, including multiple refractory assemblies 40 suspended from the frame 32, defines a panel in the furnace roof 20.

The above-described structure is known in the art and is discussed, for example, in U.S. Pat. No. 3,375,795. The present invention is directed toward the refractory assemblies 40 which are suspended from the frame 32.

One embodiment of this invention is shown in FIGS. 2–4. The refractory assembly 40 includes two refractory blocks or bricks 42 which are substantially rectangular parallelepipeds except that one side surface 44 is corrugated. The corrugated surfaces 44 may be of any number of forms, though they should match for any brick pair so that there is no gap between the corrugated surfaces 44 when the bricks 42 are placed together. Also, preferably the corrugated surfaces 44 follow a sine curve and have at least two wavelengths. By forming the brick corrugated surfaces 44 with a complete (i.e. non-fractional) number of corrugation wavelengths (such as the two full wavelengths as shown), only one type brick 42 need be formed. Thus, the bricks 42 shown in FIG. 4 are virtually identical, with one turned upside down relative to the other.

Figure 5A:
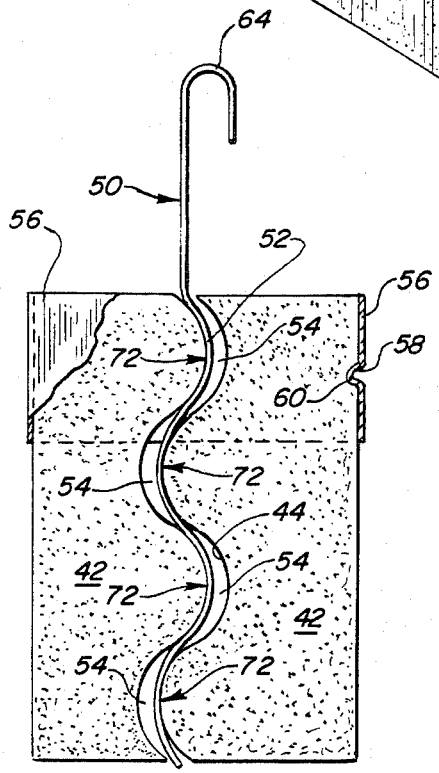
FIGS. 5A and 5B are partially broken away views of alternative embodiments of the present invention.
Figure 5B:
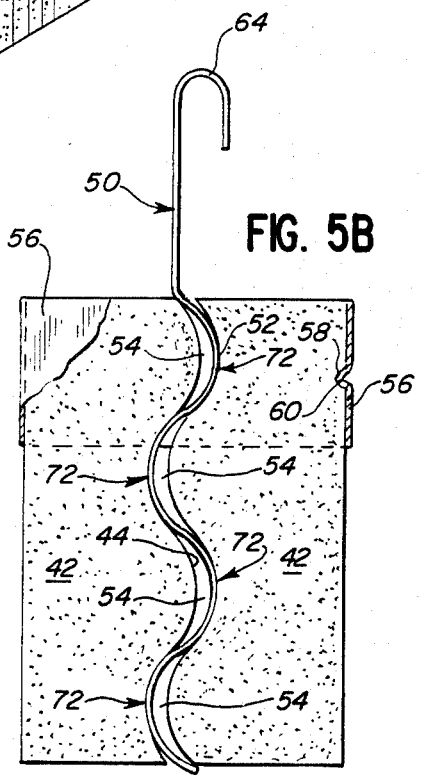
Figure 6:
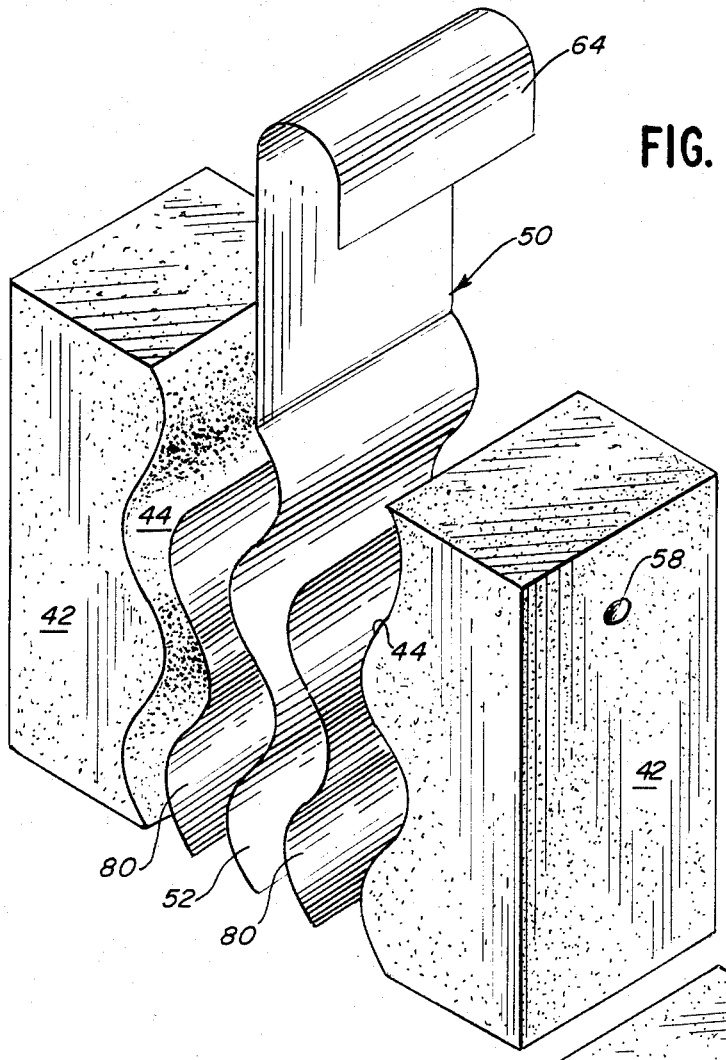
FIGS. 6 and 7 are exploded partial views of still further embodiments of the present invention.
Figure 7:
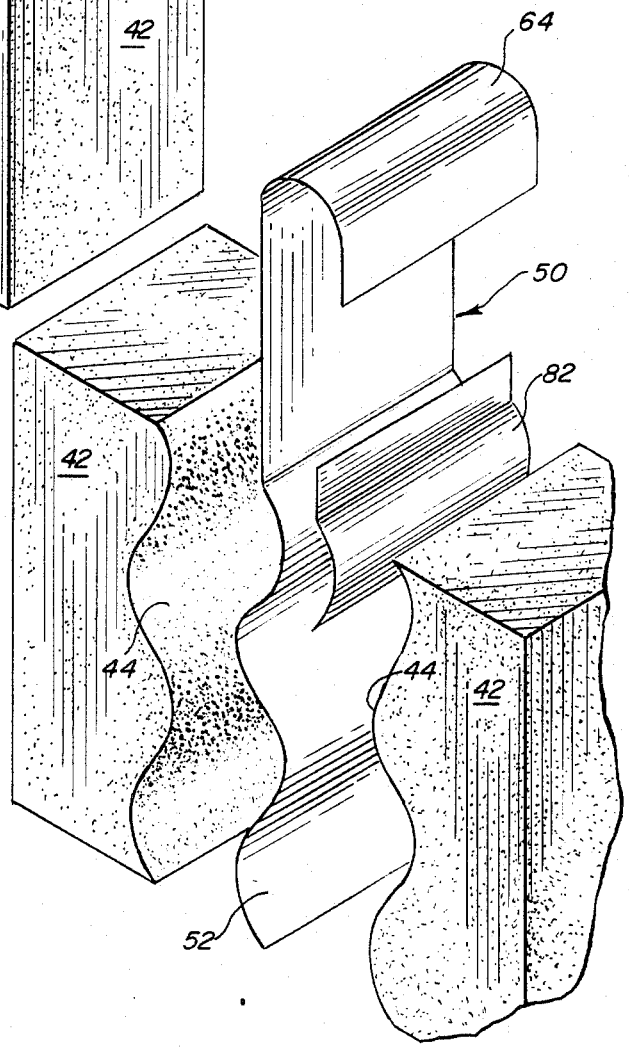

A plate 50 is located between the corrugated surfaces 44 of the bricks 42. That portion 52 of the plate 50 which is between the bricks 42 is also corrugated and its corrugations 52 are substantially in phase with the brick corrugated surfaces 44. The plate corrugations 52 have the same wavelength as the brick corrugated surfaces 44 but have a different amplitude. In one embodiment shown in FIG. 5A, the amplitude of the plate corrugations 52 is less than the amplitude of the brick corrugated surfaces 44. In an alternative embodiment shown in FIG. 5B, the amplitude of the plate corrugations 52 is greater than the amplitude of the brick corrugated surfaces 44. In either case, a spacing 54 exists when the assembly 40 is first put together.

The assembly 40 is held together by a band 56 located around the upper portion of the bricks 42. Dimples 58 are located in each of the bricks 42 and each receive an indentation 60 in the band 56 which secures the bricks 42 vertically with respect to the band 56. In the case of identically formed bricks 42 as previously described, those dimples 58 are drilled or otherwise formed in opposite ends of the bricks 42 in a pair. If the dimples 58 are molded in, it is preferable to mold in a dimple 58 at both ends so that only one type of brick 42 need be made, so that any brick 42 can be inverted to match with another.

The spacing 54 between the bricks 42 and plate 50 is selected to allow for the expected permanent and thermal expansion which will occur with the bricks 42 over the life of the assembly 40, so that expansion will fill this spacing 54 (as is described in detail below with reference to FIGS. 11–13) rather than forcing out the outer perimeter of the roof 20. The spacing 54 is determined from the design (expected) amount of expansion, and is controlled by the band size and relative plate and brick corrugation amplitudes. Thus, for example, if the bricks together have a ten inch width and a total amount of 10% expansion is expected, then the plate corrugations 52 will have an amplitude one inch greater than (or less than) the brick corrugated surface amplitude and the band 56 would secure the assembly at an eleven inch width.

At the top of the plate 50 is a hooked portion 64 which fits over a pipe member 36. As can be seen in particular in FIGS. 5A and 5B, the band 56 holds the bricks 42 together against the plate corrugations 52 so that the plate 50, in addition to allowing for expansion of the bricks 42, will also support the bricks 42. The interference of the brick corrugated surfaces 44 with the plate corrugations 52 prevents the bricks 42 from sliding down over the plate 50 when the entire assembly 40 is supported by the hooked portion 64 at the upper end of the plate 50. This occurs whether the amplitude of the plate corrugations 52 is less than (FIG. 5A) or greater than (FIG. 5B) the amplitude of the brick corrugated surfaces 44.

Still further, inasmuch as the plate 50 extends across the width of the bricks 42, it acts as a heat barrier in the spacing 54 which is provided to allow for expansion. The plate 50 touches each brick 42 once per wavelength and each area of contact 72 extends across the width of the assembly 40, thereby acting as a barrier against heat rising between the bricks 42.

Still other alternative structures embodying the present invention are shown in FIGS. 6–10. In the embodiment shown in FIGS. 6 and 7, the plate 50 is made of carbon steel, such as Detrick Refractory Metal TM, and reinforcing plates (80 in FIG. 6, 82 in FIG. 7) made of relatively expensive stainless steel are included against the plate 50 and between the bricks 42. With this structure, the added corrosion resistance of stainless steel may be provided to protect the assembly 40, particularly the plate 50, against the harsh atmosphere of the furnace, while also minimizing the cost of the assembly 40.

Figure 8:
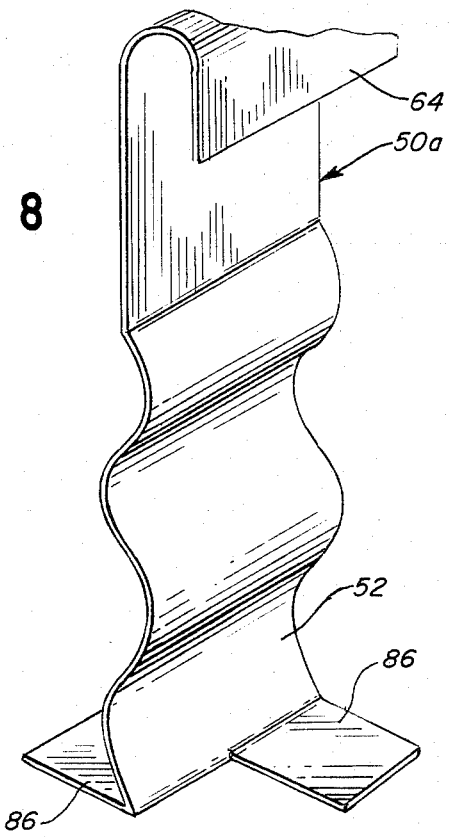
FIGS. 8–10 are partial perspective views of three different embodiments of a plate which may be used with the present invention.

An alternative embodiment of the plate 50*a* is shown in FIG. 8. The plate 50*a* is split at the bottom and flanges 86 are formed by bending the split portions outwardly in opposite directions. Though these flanges 86 will burn away during the initial period of use of the assembly 40, they will nevertheless help in supporting the bricks 42 during assembly, transport, and installation in the furnace roof 20.

Figure 9:
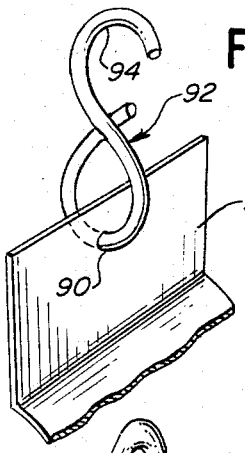
Figure 10:
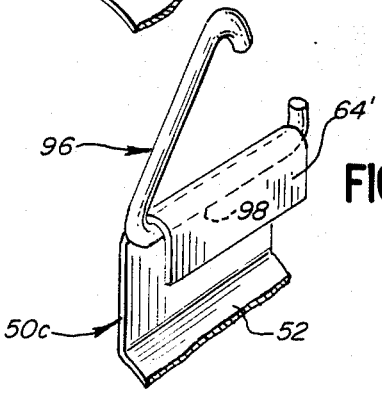

FIGS. 9 and 10 shown alternative structures for supporting the assembly 40 on the pipe member 36 of the frame 32, both structures decreasing the amount of material required for the plate 50*b*. In the embodiment shown in FIG. 9, the plate 50*b* has a hole 90 in its top center and a S-hook 92 extends through the hole 90. The top bight 94 of the S-hook 92 may be positioned in a desired direction so that the assembly hangs in the desired angular position relative to the pipe member 36 of the frame 32. The alternative embodiment shown in FIG. 10 includes a triangular hook 96 having a leg 98 which is received in the plate hook portion 64′ (the plate 50*c* between the hook portion 64′ and the corrugations 52 being shortened). This structure also enables the assembly 40 to be turned 90° from the way it would hang with the hook portion 64 as shown in FIGS. 2–7.

The ability to turn the assemblies 40 is important because, though generally it is desirable for the plate 50 to face the sides of the furnace (since it is the lateral expansion which is most important to accommodate), some of the assemblies 40 may also be turned 90° to allow for longitudinal expansion of the roof 20. When this is done, the relative plate corrugation amplitudes and brick corrugated surface amplitudes may be selected so that each assembly 40 accommodates expansion in that direction of several assemblies 40. Thus, for example, where expansion in both directions is to be equally accommodated, the panels defined by the frame 32 would be formed in a checkerboard fashion, with half of the assemblies 40 installed with their plates 50 facing longitudinally and the other half installed with their plates 50 facing sideways. Each of the assemblies 40 would therefore be designed to accommodate the expansion of two assemblies 40.

Still other structures for hanging the assemblies 40 can be used, such as a plate (not shown) which is tapered above its corrugations to a narrow hook portion, thereby enabling the assembly to be hung partially beneath the angle irons 34 of the frame 32 to prevent gaps between panels in the roof 20 and also enabling hooks to be easily slid beneath the hook portion 64 when replacing the assembly 40.

Replacement of the above-described assemblies 40 can be accomplished in the same manner as with the refractory assemblies of the prior art. That is, a group of assemblies which have burned away so much as to require replacement will glow on top, indicating to the maintenance people that they must be replaced. As previously noted, different parts of the same roof 20 will burn away at different rates, due to varying conditions within the furnace. Therefore, only small portions of the roof 20 generally require replacement at any one time. To replace those assemblies 40, a maintenance person gets on the girders 24,28 above those assemblies 40 and drops down a long hook which hooks under the plate hook portion 64, then lifts the old assemblies out of the frame 32 with the long hook and replaces them with new assemblies 40.

Figure 11:
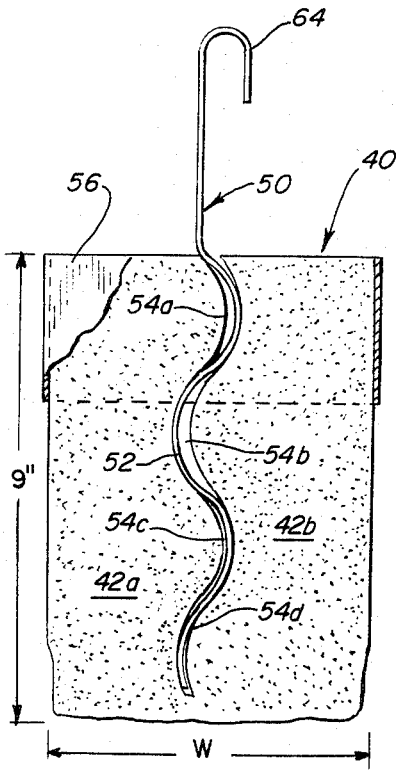
FIGS. 11–13 are partially broken views similar to FIG. 5B showing an assembly in various stages of its life.
Figure 12:
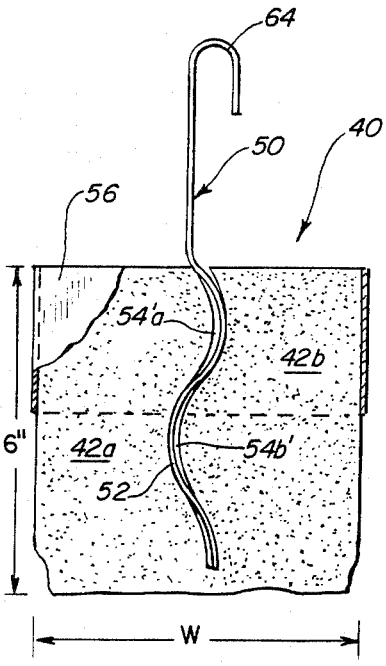
Figure 13:
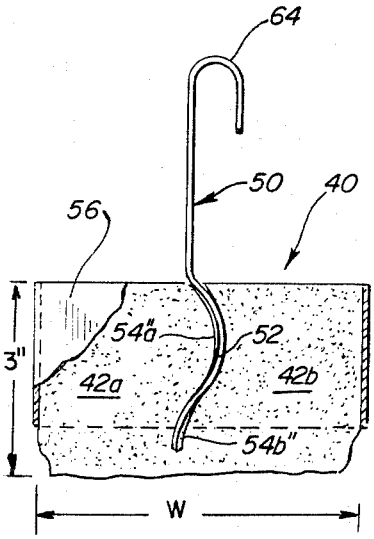

The burning away of particular assemblies 40, as well as the capability of the assemblies 40 disclosed herein to accommodate expansion, is illustrated in FIGS. 11–13. An assembly 40 having nine inch height bricks 42 is shown in its initial stages of use in FIG. 11. (The left brick is identified by reference numeral 42*a* and the right brick is identified by reference numeral 42*b* in FIGS. 11–13.) As can be seen, the upper portion of the assembly 40 is relatively unaffected, with only small amounts of thermal expansion and substantially the entire original spacings 54*a*,54*b* between the plate 50 and the bricks 42*a*,42*b*. Toward the bottom of the assembly 40 however, where the bricks 42*a*,42*b* are hotter, substantially more thermal expansion has occurred, with expansion in the right brick 42*b* distorting the plate 50 so as to partially flatten the corrugations 52 and expansion in the left brick 42*a* toward the plate 50 so that the spacing 54*c* is substantially reduced. At the bottom of the assembly, the thermal expansion is maximum, and chemical expansion is also occurring so as to substantially shut the spacing 54*d* between the bricks 42*a*,42*b*. The harsh environment of the furnace not only wears away the bricks 42*a*,42*b*, but it also reacts with the plate 50 and bricks 42*a*,42*b* so that the lower end of the plate 50 tends to lose its identity and blend in with the bricks 42*a*,42*b*. In FIGS. 11–13, this is shown as closing off the bottom of the assembly 40, though in some instances, there may still be a space between the plate 50 and bricks 42*a*,42*b*. With or without such a space however, the necessary heat barrier is provided by the areas of contact between the plate 50 and bricks 42*a*,42*b* above the bottom of the assembly 40.

The assembly 40 is shown in FIG. 12 after it has burned down to a height of approximately six inches. In this condition, the bricks 42*a*,42*b* are hotter at their top than they were in FIG. 11 and thus substantially more thermal expansion has taken place, partially flattening out the upper portions of the plate corrugations 52 and substantially reducing the spacings 54*a*′,54*b*′ in the upper part of the assembly 40. The bottom portion of the assembly 40 is substantially the same as described with respect to FIG. 11, and has both chemical and maximum thermal expansion.

The assembly 40 is shown with only three inches remaining in FIG. 13. This height is the height at which such assemblies 40 generally must be replaced. Here, the bricks 42*a*,42*b* exhibit maximum expansion throughout substantially their entire height, and thus the remaining spacings 54*a*″,54*b*″ are virtually closed. Nevertheless, the expansion throughout the stages shown in FIGS. 11–13 occurs inward toward the plate 50 due to the binding force of the band 56, and thus the overall width of the assembly 40 remains at W at all times.

It can thus be seen that the disclosed refractory assemblies 40 are effective, reliable and inexpensive. Only one type of brick 42 needs to be produced, and no sockets are required in the bricks 42, thereby reducing the susceptibility of the bricks 42 to breaking and maintaining the desired refractory characteristics of the bricks 42. Each assembly 40 allows for expansion of the bricks 42, and by the same structure supports the bricks 42 in the assembly 40. Even while allowing for the expansion of the assembly 40, the assembly 40 nevertheless maintains a heat barrier.

Other aspects, objects and advantages of the present invention can be obtained from a study of the drawings, the specification and the appended claims.

We claim:

1. A refractory assembly for use in the roof of an ore reduction furnace or the like, comprising:

a pair of refractory blocks, each block having a corrugated surface which is substantially matchable with the corrugated surface of the other block in the pair;

a plate contacting each block at least once on each corrugated surface on alternating sides along the plate height, the contacts between the plate and blocks extending across the width of the contacted block surface to act as a heat barrier while allowing expansion; and means for suspending the assembly as part of a furnace roof.

2. The assembly of claim 1, wherein the plate contacts each block at least once per wavelength of the corrugations.

3. The assembly of claim 2, wherein the plate is also corrugated and acts to support the blocks, the corrugations having a wavelength equal to and an amplitude different than that of the block corrugated surfaces.

4. The assembly of claim 3, wherein the plate and block corrugations are substantially sine curves.

5. The assembly of claim 3, wherein the plate corrugation amplitude is greater than the block corrugation amplitude.

6. The assembly of claim 3, wherein the amplitude of the plate corrugations is greater than that of the block corrugated surfaces so that the lands of the plate corrugations contact grooves of the block corrugated surfaces.

7. The assembly of claim 3, wherein the amplitude of the plate corrugations is greater than that of the block corrugated surfaces an amount substantially equal to the amount of expansion expected in the life of the block pair.

8. The assembly of claim 1, further comprising flanges on opposite sides of the bottom of the plate, the flanges helping to support the blocks when first assembled.

9. The assembly of claim 1, further comprising a band around the top of the block pair and holding the blocks against the plate.

10. The assembly of claim 9, wherein the band is larger than the block pair when matched together by an amount equal to the amount of expansion expected in the life of the block pair.

11. The assembly of claim 10, further comprising means for fixing the band to each of the blocks to maintain the blocks in vertical alignment.

12. The assembly of claim 11, wherein the fixing means comprises a dimple in each of the blocks within which identations on each of the bands are received.

13. The assembly of claim 2, wherein the height of the blocks is at least two wavelengths.

14. A refractory assembly for use in panelized furnace roofs, comprising:

a pair of heat refractory blocks, each block having a corrugated surface which is substantially matchable with the corrugated surface of the other block in the pair, the corrugated surfaces having a selected wavelength and amplitude;

a corrugated plate substantially as wide as the blocks and having means on its upper end for supporting the assembly, the plate corrugations having the selected wavelength and having a second amplitude different from the selected amplitude; and means for binding the plate between the corrugated surfaces of the block pair so that the blocks are supported on the plate.

15. The assembly of claim 14, wherein the corrugations are substantially sine curves.

16. The assembly of claim 14, wherein the second amplitude is greater than the selected amplitude by an amount substantially equal to the amount of expansion expected in the useful life of the block pair.

17. The assembly of claim 14, wherein the second amplitude is greater than the selected amplitude so that the lands of the plate corrugations engage grooves in the corrugated surfaces of the blocks.

18. The assembly of claim 14, further comprising a reinforcing plate located on and conforming to the corrugated plate at the top of the block pair.

19. The assembly of claim 14, further comprising a pair of reinforcing plates located on either side of the corrugated plate, the reinforcing plates having corrugations conforming to the corrugated plate.

20. The assembly of claim 14, further comprising block supporting flanges on both sides at the bottom of the plate.

21. The assembly of claim 14, wherein the binding means comprises a band about the top of the block pair.

22. The assembly of claim 21, further comprising means for fixing the band to each of the blocks to maintain the blocks in vertical alignment.

23. The assembly of claim 22, wherein the fixing means comprises a dimple in each of the blocks receiving projections on the band.

24. The assembly of claim 14, wherein the height of the blocks is at least two wavelengths.

25. A refractory assembly for use in a panelized furnace roof, comprising:

a pair of refractory blocks, each block having a surface conforming to a vertically aligned sine curve having a selected wavelength and amplitude, the blocks being matchable with their curved surfaces together;

a plate substantially as wide as the blocks, said plate having a hook on its upper end for supporting the assembly as part of the roof and having a sine curve configuration at its lower end, the curve configuration having the selected wavelength and a second amplitude greater than the selected amplitude; and a band around the upper portion of the block pairs, the band holding the block pairs together around the plate so that the blocks are spaced apart by and supported by the plate, thereby allowing expansion of the blocks in the space therebetween.

26. A panel for use in furnace roofs, comprising:

a frame having a plurality of spaced support bars;

a plurality of refractory assemblies supported by the bars, the assemblies abutting one another when supported to form a solid refractory panel, each of the assemblies comprising a pair of refractory blocks having matchable corrugated surfaces of a selected wavelength and amplitude, a plate substantially as wide as the blocks and having means on its upper end for attaching to one of the bars and having corrugations on its lower end of the selected wavelength and of a second amplitude different than the selected amplitude, and means for binding the lower end of the plate between the corrugated surfaces of the block pair.

27. The panel of claim 26, wherein for each assembly, the second amplitude is greater than the selected amplitude.

28. The panel of claim 26, wherein for each assembly, the corrugations substantially conform to sine curves.

29. The assembly of claim 3, wherein the height of the blocks is a multiple of the corrugation wavelength.

30. The assembly of claim 14, wherein the height of the blocks is a multiple of said selected wavelength.

* * * * *